US006182381B1

(12) United States Patent
Kaneko et al.

(10) Patent No.: US 6,182,381 B1
(45) **Date of Patent: *Feb. 6, 2001**

(54) SOLE OF BASEBALL SPIKED SHOE AND METHOD OF MEASURING SHEARING STRESS DISTRIBUTION OF BASEBALL SPIKED SHOE

(75) Inventors: Yasunori Kaneko; Makoto Tsuchiya, both of Osaka (JP)

(73) Assignee: Mizuno Corporation, Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/743,273

(22) Filed: Nov. 4, 1996

(30) Foreign Application Priority Data

Dec. 25, 1995 (JP) ..... 7-351507

(51) Int. Cl.[7] ..... A43C 15/00; A43B 23/28; A43B 5/00

(52) U.S. Cl. ..... 36/126; 36/67 A; 36/67 B; 36/59 R; 36/66

(58) Field of Search ..... 36/126, 128, 67 A, 36/67 B, 67 R, 102, 59 R, 59 C, 66

(56) References Cited

U.S. PATENT DOCUMENTS

| | | | | |
|---|---|---|---|---|
| 1,012,197 | * | 12/1911 | Golden | 36/126 |
| 1,242,056 | * | 10/1917 | Skiles | 36/126 |
| 1,596,600 | * | 8/1926 | Dickson | 36/59 R |
| 1,846,617 | * | 2/1932 | Seremba | 36/126 |
| 2,001,976 | * | 5/1935 | Riddell | 36/126 |
| 2,163,089 | * | 6/1939 | Hagerty | 36/59 R |
| 2,416,526 | * | 2/1947 | Koenig | 36/59 R |
| 2,878,592 | * | 3/1959 | Cisko, Jr. | 36/126 |
| 3,029,529 | * | 4/1962 | Schwartz | 36/126 |
| 4,194,310 | * | 3/1980 | Bowerman | 36/59 R |
| 4,527,344 | * | 7/1985 | Mozena | 36/126 |
| 4,590,693 | * | 5/1986 | Kawashima et al. | 36/126 |
| 4,667,425 | * | 5/1987 | Effler et al. | 36/59 R |
| 5,384,973 | * | 1/1995 | Lyden | 36/102 |
| 5,766,802 | * | 6/1998 | Bramani | 36/28 |

FOREIGN PATENT DOCUMENTS 6-21408 3/1994 (JP) .

* cited by examiner

*Primary Examiner*—Paul T. Sewell
*Assistant Examiner*—Anthony Stashick
(74) *Attorney, Agent, or Firm*—McDermott, Will & Emery

(57) ABSTRACT

A sole of a baseball spiked shoe has a toe portion projection, a first metatarsal head projection, a stepping portion projection, and a fifth metatarsal head projection provided at a fore foot portion at the bottom plane of the shoe sole, and a heel medial projection, a heel anterior projection, a heel posterior projection, and a heel lateral projection provided at the heel portion. Each projection is provided at an appropriate angle with respect to the longitudinal line of the foot.

40 Claims, 18 Drawing Sheets

SOLE OF BASEBALL SPIKED SHOE AND METHOD OF MEASURING SHEARING STRESS DISTRIBUTION OF BASEBALL SPIKED SHOE

BACKGROUND OF THE INVENTION

1. Field of the Invention

The present invention relates to a sole of a baseball spiked shoe, and a method of measuring shearing stress distribution of a baseball spiked shoe. More particularly, the present invention relates to the sole of baseball spiked shoes that provides superior sliding resistance in any action in a baseball play such as batting, throwing, and running, and that improves flexibility of the foot action during the play. Also, the present invention relates to a method of measuring shearing stress distribution of a baseball spiked shoe.

2. Description of the Background Art

Conventional baseball spiked shoes, particularly those with metal spikes, have the so-called triangular shaped blades provided on the sole. More specifically, as shown in FIG. 17A, three blade-like protrusions at respective positions at the fore foot portion and the heel portion are joined by a connecting washer so as to be located at the vertices of a triangle, and fastened by a fixing pin and the like at respective holes formed in the connecting washer.

A baseball spiked shoe as shown in FIG. 17B is also used. Such a baseball spiked shoe has the triangular shaped blades of the fore foot portion divided into a toe portion spike and a stepping portion spike in order to improve the flexibility of the fore foot portion of the shoe sole.

Also, a baseball spike shoe having auxiliary projections provided to the conventional triangular shaped blades as shown in FIG. 18 for the purpose of improving sliding resistance is disclosed in Japanese Patent Laying-Open No. 6-21408.

A baseball shoe with the above-described triangular shaped blades had almost no flexibility at the fore foot portion since a connecting washer of high rigidity is fixed over a large area at the fore foot portion from the toe portion to the stepping portion. When a person wearing such baseball spiked shoes shifts his or her weight frontward at the time of running to kick the ground, his or her foot will move within the shoe since the sole cannot accurately follow the flexing fore foot portion. The initial kicking force cannot be reliably conveyed against the ground.

A similar problem is encountered when the player moves sideways. The shoe sole cannot accurately follow the eversion and inversion shape of the foot portion. The foot will move inside the shoe, so that the kicking force cannot be reliably conveyed against the ground. Such disadvantages could not be solved by the baseball spiked hardware disclosed in the aforementioned Japanese Patent Laying-Open No. 60-21408.

The typical actions during a baseball play are the four actions of batting, throwing, fielding, and running. The strength of a player's leg could not be exercised sufficiently in respective actions with the conventional worn spiked shoes. For example, when a right-handed batter is at bat, the right foot functions as a pivoting foot to exhibit a great kicking force centering about the anterior portion of the first metatarsal head at the time of ball-impact. However, since there is no projection in a conventional spiked shoe at the anterior portion of the first metatarsal head and the projection provided in the proximity of the first metatarsal head is provided parallel to the direction of the kicking force, a great force cannot be generated. The shoe sole will slide on the ground to result in loss of the kicking force.

When a right-handed player throws a ball, a great kicking force is imparted from the stepping portion to the heel portion of the right foot in the action starting from take back to the down swing of the player's arm. At the moment the ball leaves the player's hand, a great braking force is imparted from the heel portion to the stepping portion of the left foot. Since a conventional spiked shoe has only one projection provided at the toe portion, which is located at right angles with respect to the longitudinal line of the foot, the kicking force at the toe portion of the right foot could not be conveyed sufficiently against the ground. Furthermore, there is only one projection provided as perpendicular to the longitudinal line of the foot at the heel portion of the left foot shoe, so that a sufficient braking force could not be exercised.

As to the kinetic performance of a baseball player during fielding and running, the movement can be classified into the case where the player makes a dash straight forward, and the case where the player turns his body and makes a dash in that direction. When the player dashes straight forward, the load path on the sole of the spiked shoe shows a trajectory starting from contact of the heel on the ground to the toe portion via the lateral side of the plantar arc, the lateral side of the stepping portion, and the medial side of the stepping portion.

Although a conventional spiked shoe has a projection provided at the first metatarsal head, the direction of the projection is parallel to the direction of the transfer of weight. An adequate kicking force could not be exercised, resulting in loss of force. When the player makes a dash sideways in the right direction, the region of the left foot from the toe portion to the medial side of the stepping portion kicks against the ground while the toe of the right foot is pointed towards the forwarding direction to dart off. Since the projections provided at the first metatarsal head and at the toe of a conventional spiked shoe are substantially parallel to the direction of the kicking force, there was loss in force.

Although flexibility corresponding to various movements is required in spiked shoes, the sole of a conventional spiked shoe does not have a flexion groove provided at an effective position.

SUMMARY OF THE INVENTION

In view of the foregoing, a main objective of the present invention is to provide a method of analyzing various movements of a spiked shoe in a baseball play for measuring the direction of shearing stress acting on a shoe sole and an area of force application.

Another objective of the present invention is to provide a sole of a baseball spiked shoe having the required position and direction of a projection determined according to the measured direction of shearing stress and area of force application.

According to an aspect of the present invention, a toe portion projection, a first metatarsal head projection, a stepping portion projection, and a fifth metatarsal head projection are provided at a fore foot portion on a sole of a baseball spiked shoe.

Since respective projections are provided at the fore foot portion in the present invention, kicking force and the like in a kinetic performance can reliably be conveyed to the ground to improve exercise efficiency.

According to another aspect of the present invention, a heel medial projection, a heel posterior projection, and a heel lateral projection are provided at a heel portion.

Also preferably, a heel anterior projection is provided at the heel portion.

According to a further aspect of the present invention, a sole of a baseball spiked shoe includes a toe portion projection, a first metatarsal head projection, a stepping portion projection, a fifth metatarsal head projection provided at a fore foot portion, and a heel medial projection, a heel anterior projection, a heel posterior projection, and a heel lateral projection provided at a heel portion.

Further preferably, a first metatarsal head posterior projection is provided at a relatively posterior portion of the first metatarsal head projection. The toe portion projection and the first metatarsal head projection are formed integrally by a connecting washer.

Also, the stepping portion projection and the fifth metatarsal head projection are joined integrally by a connecting washer. The stepping portion projection, the fifth metatarsal head projection, and the first metatarsal head posterior projection are formed integrally by a connecting washer. Furthermore, the heel medial projection, the heel anterior projection, the heel posterior projection, and the heel lateral projection are joined integrally by a connecting washer.

According to still another aspect of the present invention, a method of measuring shearing stress distribution of a baseball spiked shoe includes the step of measuring distribution of compressive stress in the vertical direction of a shoe sole as foot stress distribution data for every short period of time when a subject moves with a baseball spiked shoe, the step of simultaneously measuring stress in the three dimensional direction of the shoe sole for every short period of time, and the step of analyzing a resultant force vector of the measured compressive stress in the vertical direction and the stress in the horizontal direction as triaxial components to obtain foot stress distribution data and load vector data for determining a shearing stress distribution diagram.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
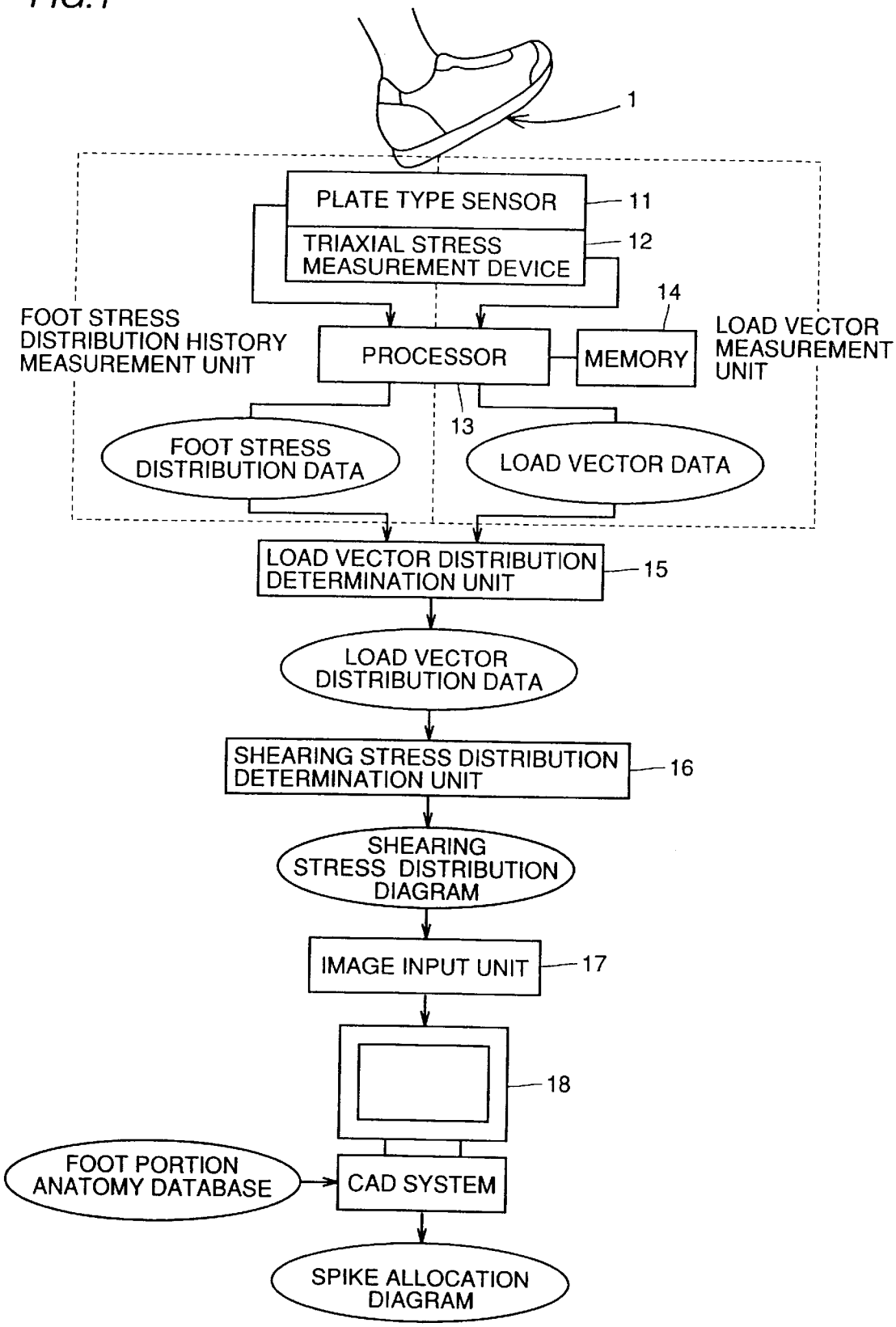
FIG. 1 is a diagram for describing a method of measuring a shearing stress distribution of a spiked shoe according to the present invention.

Referring to FIG. 1, a plate type sensor 11, a triaxial stress measurement device 12, a processor 13, and a memory 14 are provided for measurement to obtain a shearing stress distribution. A subject wearing a shoe of a relatively planar sole design moves on plate type sensor 11. Distribution of compressive stress in the vertical direction in the region of plate type sensor 11 in contact with the bottom of the shoe sole is measured for every short period of time as foot stress distribution data to be stored in memory 14 via processor 13.

Triaxial stress measurement device 12 is installed within another plate type sensor provided beneath plate type sensor 1. Measurement of stress in the three dimensional direction at a moment identical to that of the foot stress distribution measurement by plate type sensor 11 is provided by triaxial stress measurement device 12. A resultant force vector of the stress in the vertical direction and the horizontal direction is analyzed as triaxial components. Measurement is provided for every short period of time, and load vector data is stored in memory 14 via processor 13.

Foot stress distribution data and load vector data obtained as described above are applied to a load vector distribution determination unit 15, whereby load vector distribution is determined. The load vector distribution data is applied to a shearing stress distribution determination unit 16 to have a shearing stress distribution determined.

Figure 2:
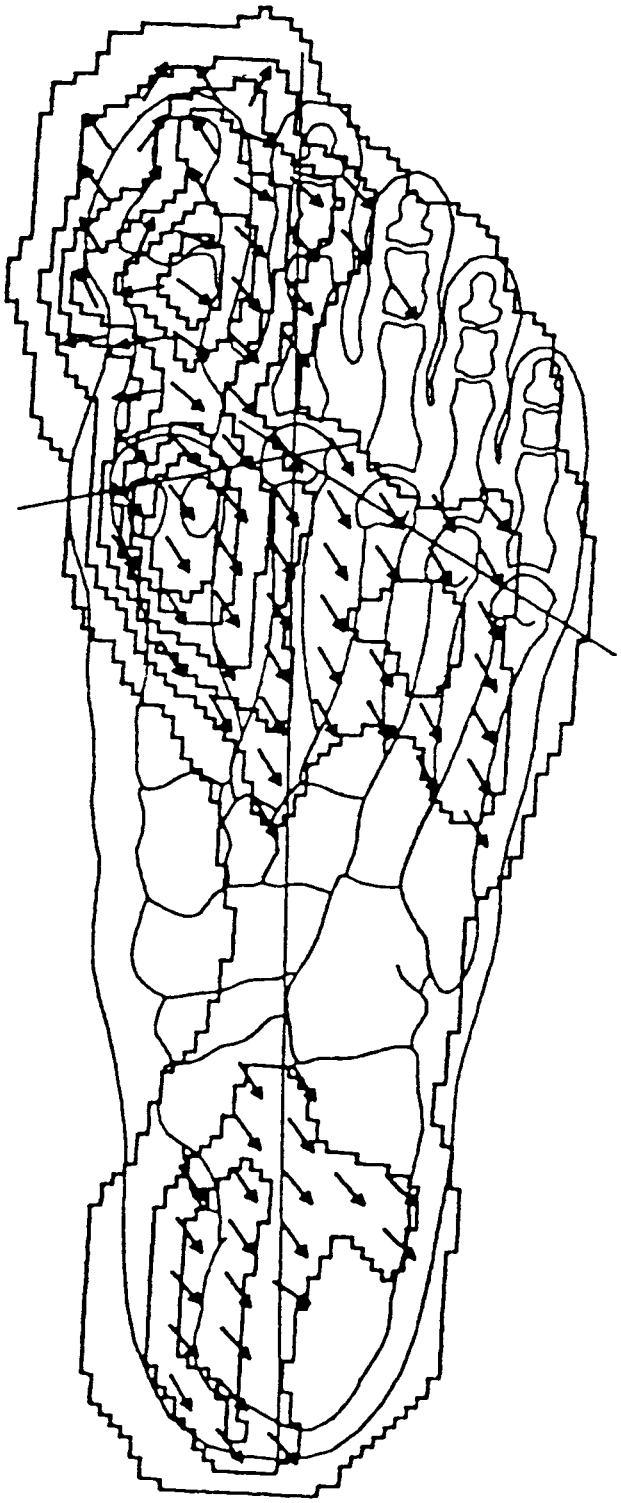
FIG. 2 is a diagram showing a measured shearing stress distribution.

An example of a determined shearing stress distribution is shown in FIG. 2. This diagram represents the shearing stress distribution in the form of contour lines.

The shearing stress distribution diagram determined by shearing stress distribution determination unit 16 is applied to a CAD system 18 from an image input unit 17 such as a scanner. Alternatively, the shearing stress distribution diagram can be transferred to CAD system 18 directly as data via a floppy disc or via a computer network, and then drawn by a program in the CAD system.

In CAD system 18, various data such as foot length, foot width, position of first metatarsal head are added using a foot portion anatomy database. The position and direction of a projection are determined according to the shearing stress distribution diagram.

FIGS. 3–6 are plan views of a shoe sole according to an embodiment of the present invention.

At the bottom plane of a shoe sole body 1, nine projections, i.e. toe portion projections T1 and T2, a first metatarsal head projection T3, a stepping portion projection M1, a fifth metatarsal head projection M2, a heel medial projection H1, a heel anterior projection H2, a heel posterior projection H3, and a heel lateral projection H4 are provided.

In the present embodiment, appropriate projections are formed integrally by means of a first and second caller 2B and 2B connecting. More specifically, toe portion projections T1, T2, and first metatarsal head projection T3 are joined together by first connecting caller 2A. Stepping portion projection M1 and fifth metatarsal head projection M2 are joined together by first connecting caller 2A. Heel medial projection H1, heel anterior projection H2, heel posterior projection H3, and heel lateral projection H4 are joined together by third connecting washer 2C.

Figure 5:
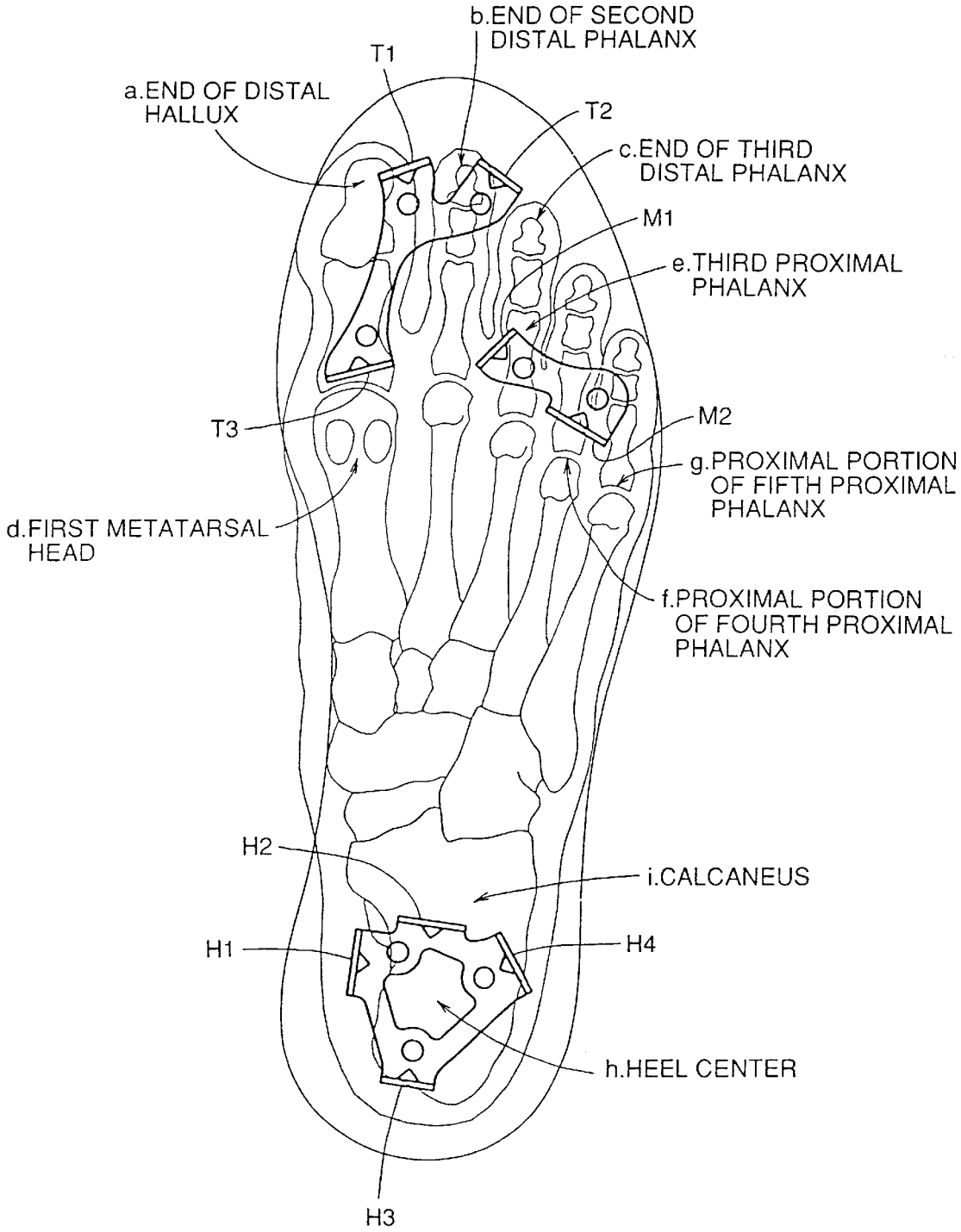
FIG. 5 schematically shows the correspondence of the location of each projection according to the present invention and the skeleton of a foot of a human body.

Each projection is provided corresponding to the skeletal layout of the foot portion as shown in FIG. 5.

More specifically, toe portion projection T1 is located corresponding to a position between an end of distal hallux a and an end of second distal phalanx b. Toe portion projection T2 is located corresponding to a position between end of second distal phalanx b and an end of third distal phalanx c.

First metatarsal projection T3 is located corresponding to a position relatively frontward of first metatarsal head d.

Stepping portion projection M1 is located at a position corresponding to a third proximal phalanx e. Fifth metatarsal head projection M2 is located corresponding to a position between a proximal portion of fourth proximal phalanx f and a proximal portion of fifth proximal phalanx g.

Furthermore, heel medial projection H1 is located at the medial side of a heel center h, corresponding to a position at the medial side of a calcaneus i. Heel anterior projection H2 is located frontward of heel center h, corresponding to a position substantially at the center of calcaneus i. Heel posterior projection H3 is located at the posterior of heel center h, corresponding to a position posterior to calcaneus i. Heel lateral projection H4 is located at the lateral side of heel center h, corresponding to a position at the lateral side of calcaneus i.

Figure 6:
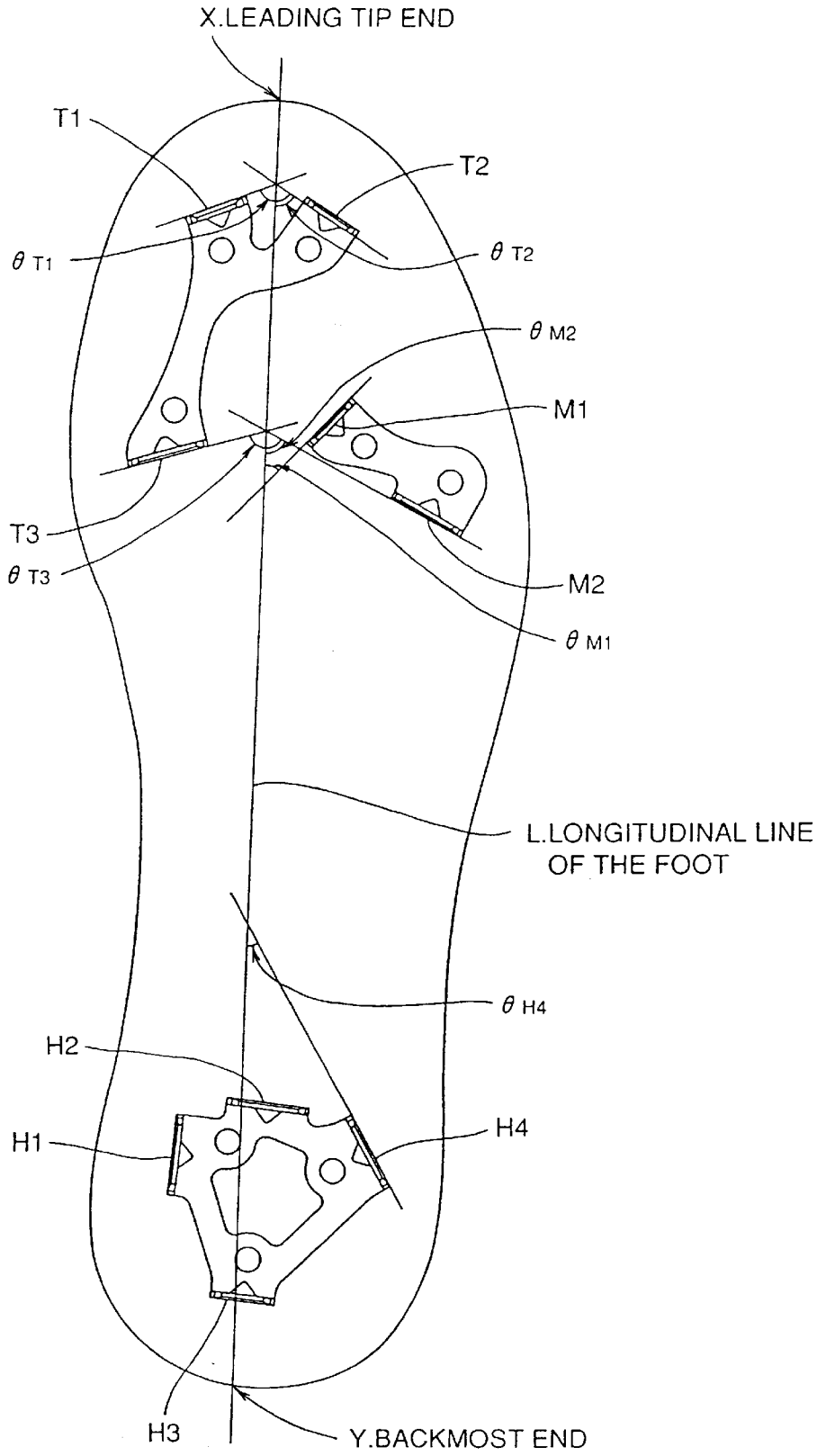
FIG. 6 schematically shows the angle of each projection according to the present invention.

The angle θ of each projection is defined as an angle between a line of extension of respective projections and a longitudinal line of the foot L as shown in FIG. 6.

Here, the longitudinal line of the foot L is a straight line connecting a leading tip end X and the backmost end Y of the heel of the sole. It is a reference line that is uniquely determined once the shape of the shoe sole is defined.

In the baseball spiked shoe of the present invention, angle $\theta_{T1}$ of toe portion projection T1 is 75°~90°. Angle $\theta_{T2}$ of toe portion projection T2 is 60°~90°. Angle $\theta_{T3}$ of first metatarsal head portion T3 is 45°~90°.

Angle $\theta_{M1}$ of stepping portion projection M1 is 30°~60°. Angle $\theta_{M2}$ of fifth metatarsal head projection M2 is 50°~80°.

Heel medial projection H1 is provided substantially parallel to longitudinal line of the foot L. Heel anterior projection H2 and heel posterior projection H3 are provided substantially perpendicular to longitudinal line of the foot L.

Angle $\theta_{H4}$ of heel lateral projection H4 is 20°~45°.

The position and angle of respective projections are determined according to the shearing stress distribution diagrams shown in FIGS. 7–11. The contour line in the figures show the degree of shearing stress acting on each position at the shoe sole. The arrow indicates the direction of the shearing stress.

Figure 7:
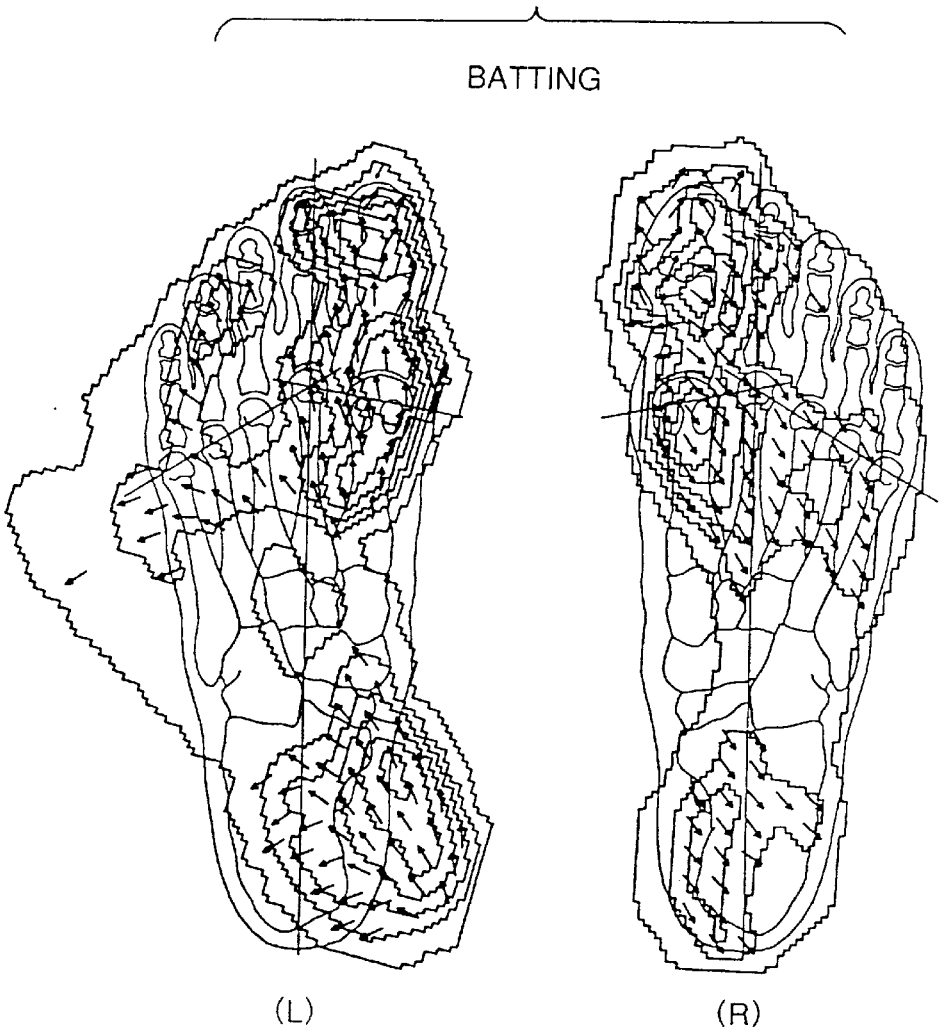
FIG. 7 is a shearing stress distribution diagram obtained from a foot stress distribution and a load vector in a batting action of a right-handed batter.

FIG. 7 is a shearing stress distribution diagram of a batting action of a right-handed batter.

The batting action can be divided into three movements, i.e. a forward swing, impact, and follow through. During the forward swing, the player's weight at the right foot shifts towards the heel medial to support actuation of the forward swing at the heel portion. Although the shearing stress acts backwards in the right direction, a firm stepping grip against this direction can be ensured by means of heel medial projection H1 and heel anterior projection H2.

Meanwhile, the left foot contacts the ground from the toe medial slightly pointing outwards to prepare for the ball-impact. Although shearing stress acts forward in the left direction, a firm stepping grip can be ensured against this direction by means of toe portion projection T1 and first metatarsal head projection T3 provided at the aforementioned angles.

Before and after the time of ball-impact, the weight of the player in the right foot gradually shifts to the stepping portion. At the moment of impact, maximum shearing stress is imparted on a region from the stepping portion to the toe portion backwards in the right direction at approximately 45° with respect to the longitudinal line of the foot. By virtue of first metatarsal head projection T3, stepping portion projection M1 and toe portion projection T1 provided at the aforementioned angles at the right foot, a firm stepping grip against this direction can be ensured.

At the left foot, the weight of the player moves from the toe to the lateral side of the heel while the toe turns outwards so that the heel receives a leftward force. A firm stepping grip against this left direction can be ensured by heel lateral projection H4.

During the follow through action, the weight at the right foot of the player shifts to the toe. A firm stepping grip against the forward direction is ensured by toe portion projections T1 and T2.

At the left foot, the weight of the player gradually shifts from the lateral side to the medial side of the heel. A firm stepping grip against the left backwards direction can be ensured by heel medial projection H1.

Figure 8:
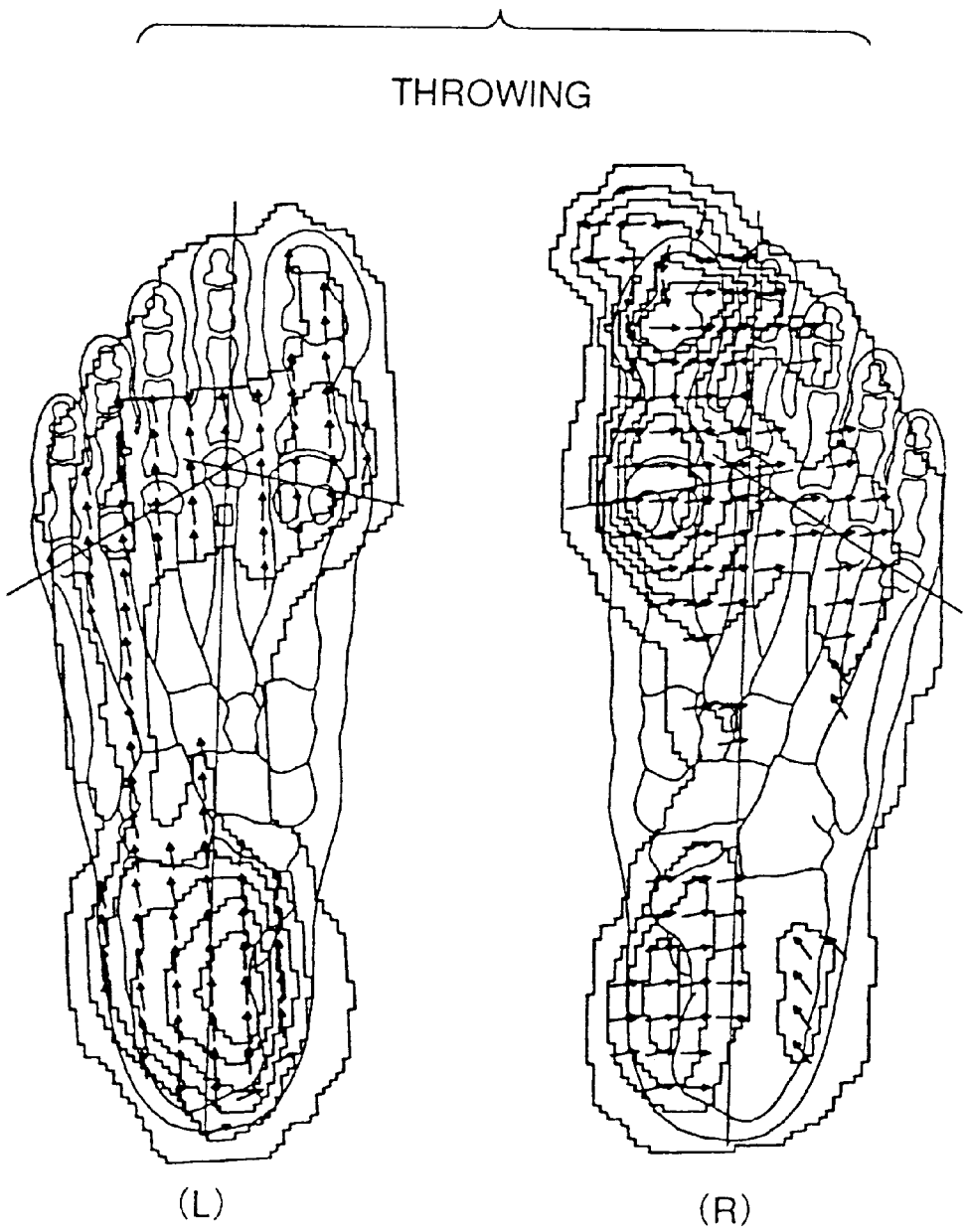
FIG. 8 is a shearing stress distribution diagram obtained from a foot stress distribution and a load vector in a throwing action of a player who throws right-handed.

FIG. 8 is a shearing stress distribution diagram of a throwing action of a player who throws right-handed.

The throwing action can be divided into three movements of swinging up the arm, swinging down the arm, and follow through.

During the motion of swinging up the arm, the right foot is located as perpendicular to the direction of the ball to be thrown. The weight of the player moves towards the heel medial, and the player begins to swing up his arm. A firm stepping grip against the right direction can be ensured by heel medial projection H1 provided at the aforementioned angle.

During the motion of swinging down the arm, the weight of the player shifts from the heel medial towards the toe medial. A strong kicking force is imparted backwards in the right direction just before the ball leaves the player's hand. A firm stepping grip against the backwards right direction can be ensured by toe portion projection T1 and first metatarsal head portion T3 provided at the aforementioned angles.

During the acceleration stage of swinging down the arm, the player's left foot contacts the ground from the heel with the toe pointed towards the pitching direction to support the torso until the moment the ball leaves the player's hand. In the former half of this acceleration stage, a secure stepping grip against the forward direction is ensured by heel posterior projection H3, heel anterior projection H2 and fifth metatarsal head projection M2. At the latter half of the acceleration stage, a firm stepping grip can be ensured by stepping portion projection M1, first metatarsal head projection T3 and toe portion projections T1 and T2 at the left foot.

During the follow through action, the weight of the player gradually shifts towards the heel medial at the left foot. A firm stepping grip can be ensured against the left direction by heel medial projection H1.

Figure 9:
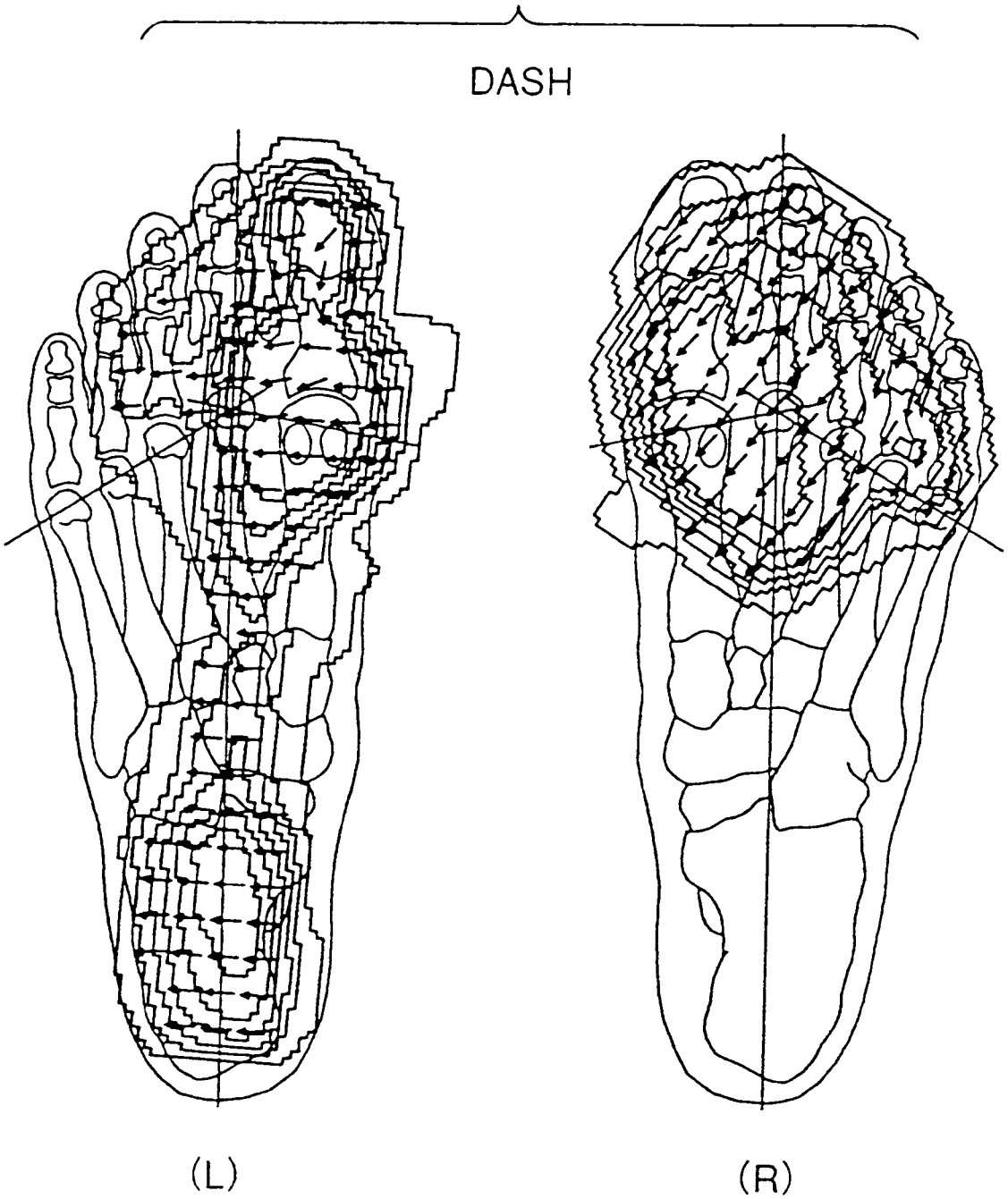
FIG. 9 is a shearing stress distribution diagram obtained from a foot stress distribution and a load vector when a player makes a dash in the right direction.

FIG. 9 is a shearing stress distribution diagram when a player makes a dash in the right direction.

In this exercise, starting from a static standing posture of the player with both feet substantially as perpendicular to the heading direction, the body of the player is turned approximately 90° rightwards to commence the acceleration stage.

During the pre-acceleration stage, the weight of the player is first placed at the medial side of the left foot. The right foot is turned so that the toe points the heading direction, followed by contacting the ground again from the stepping portion.

From the beginning to the middle period of the acceleration stage, the weight of the player at the right foot shifts from the lateral side of the stepping portion to the anterior medial side of the stepping portion. A firm stepping grip is ensured by fifth metatarsal head projection M2, stepping portion projection M1, and first metatarsal head projection T3 provided at the aforementioned angles. At the left foot, the weight of the player shifts from the medial side of the stepping portion while the left foot is positioned perpendicular to the heading direction. A kicking force in the left direction is received. A firm stepping grip can be ensured against the left direction by first metatarsal head projection T3, toe portion projection T1, and heel medial projection H1 provided at the aforementioned angles.

At the latter period of the acceleration stage, the weight of the player moves to the toe portion at the right foot to kick the ground backwards with a secure stepping grip by toe portion projections T1 and T2. The weight at the left foot also shifts towards the medial side of the toe to kick back with a firm stepping grip by toe portion projection T1 and first metatarsal head projection T3.

Figure 10:
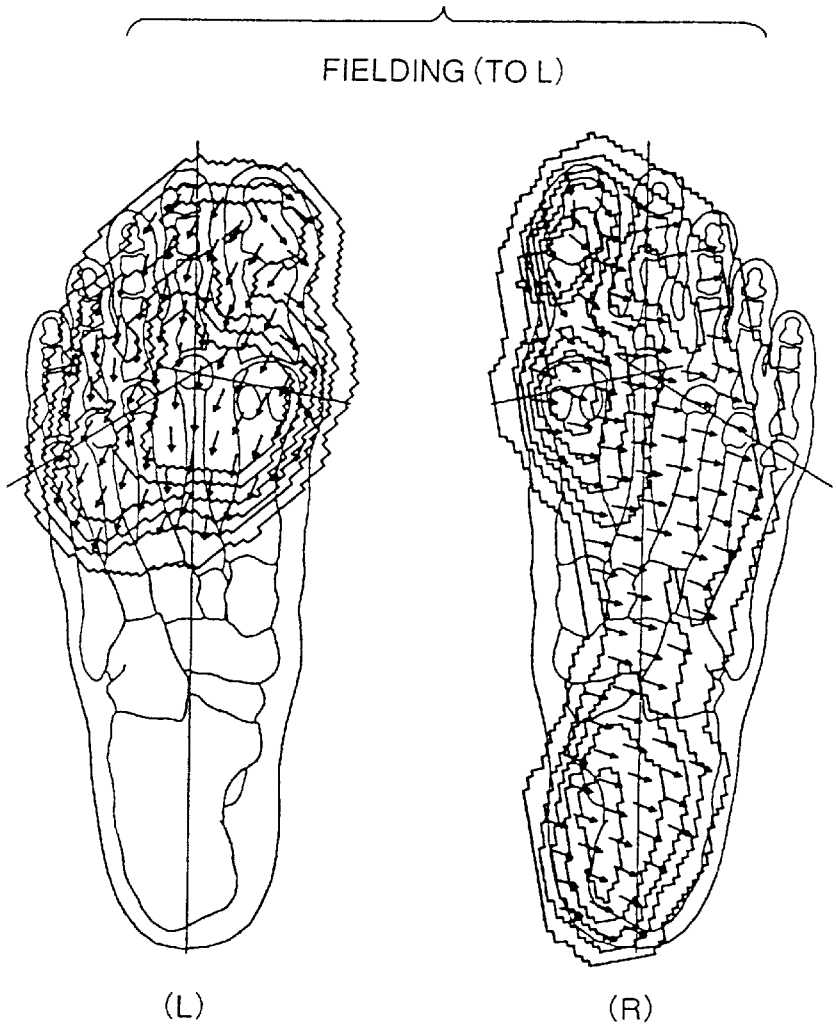
FIGS. 10 and 11 are shearing stress distribution diagrams obtained from a foot stress distribution and a load vector when a player makes a dash frontward in the left and right directions, respectively.

FIG. 10 is a shearing stress distribution diagram in making a dash frontwards in the left direction.

Here, starting from a static standing posture with both feet slightly outwards from the heading direction, the body of the player turns to the left forward heading direction to commence acceleration.

In a pre-acceleration stage, the weight of the player is first supported at the medial side of the right foot. The left foot turns so that the toe is pointed towards the heading direction, and then contacts the ground again at the stepping portion.

From the beginning period to the middle period of the acceleration stage, the weight of the left foot shifts from the medial side of the stepping portion to the entire region of the stepping portion. A firm stepping grip is ensured by first metatarsal head projection T3 and fifth metatarsal head projection M2 provided at the aforementioned angles. At the right foot, the ground-contacting area of the stepping portion is enlarged towards the lateral side. The ground-contacting area is enlarged up to the medial side heel to kick backwards in the right direction. By virtue of first metatarsal head projection T3, stepping portion projection M1, heel medial projection H1, and heel anterior projection H2, a firm stepping grip against the right backward direction can be ensured.

During the latter period of the acceleration stage, the weight at the left foot shifts to the toe portion to kick backwards with a firm stepping grip by toe portion projections T1 and T2. Also at the right foot, the weight shifts towards the medial side of the toe to kick backwards with a firm stepping grip by toe portion projection T1.

Figure 11:
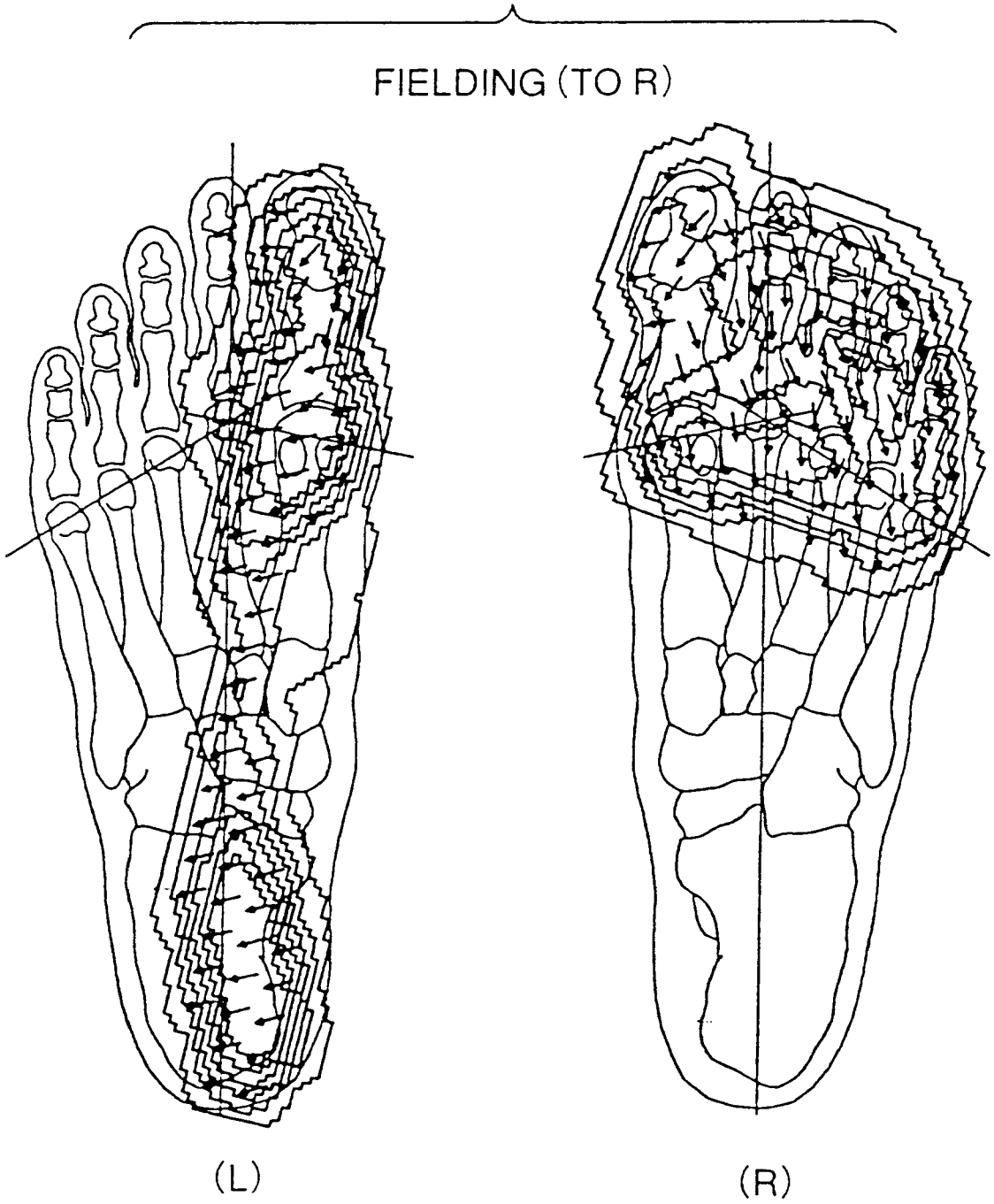
Figure 12:
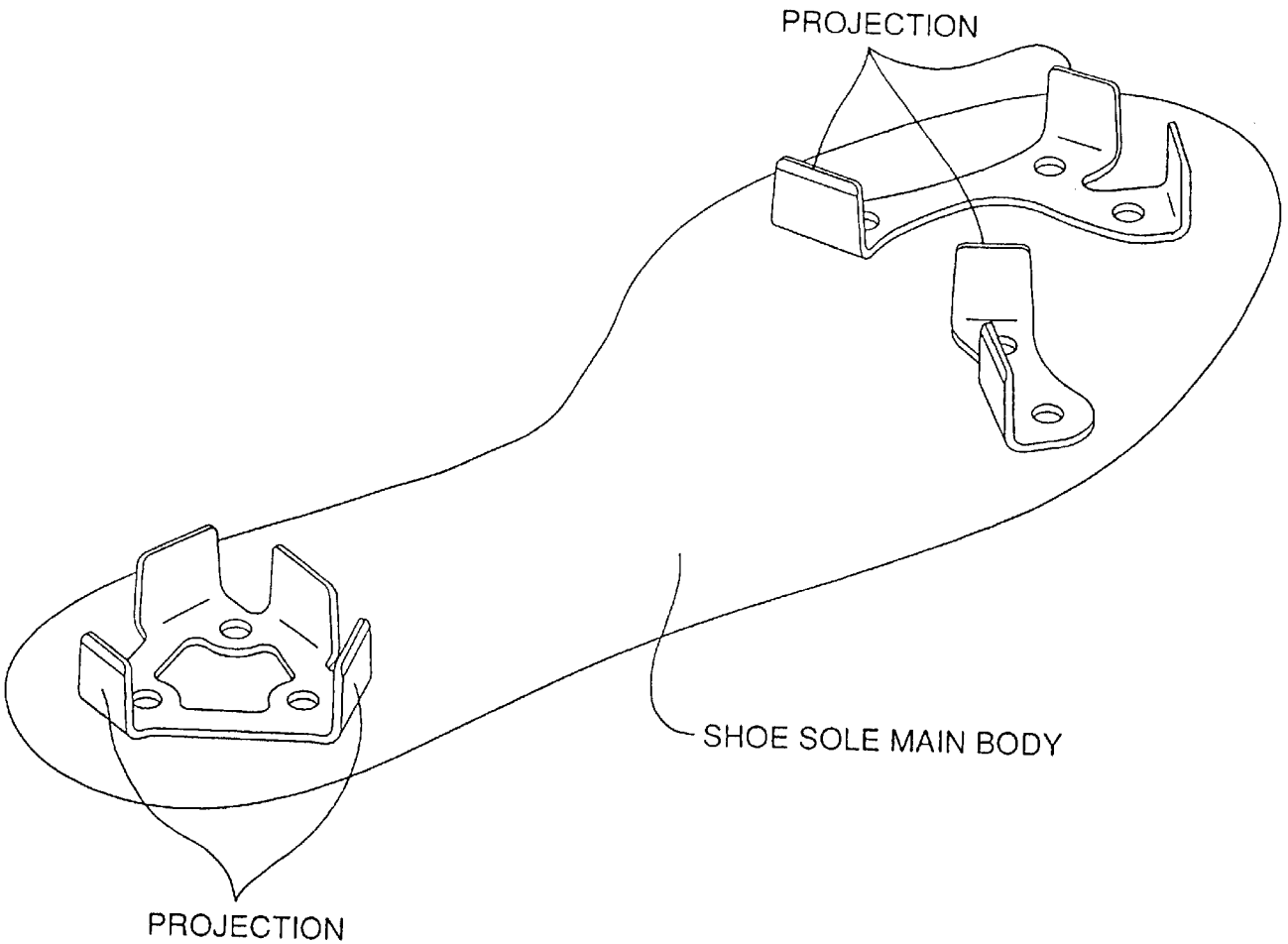
FIG. 12 is a perspective view of a shoe sole according to the present invention.

FIG. 11 is a shearing stress distribution diagram in making a dash in the right forward direction.

Here, starting from a static standing posture with both feet slightly pointing outwards from the heading direction, the body of the player turns in the right forward heading direction to commence acceleration.

In the pre-acceleration stage, the weight is first supported at the medial side of the left foot to initiate this turning action. The right foot is turned so that the toe is pointed towards the heading direction, and then contacts the ground at the medial side of the stepping portion.

From the initial period to the middle period of the acceleration stage, the weight at the right foot shifts from the medial side of the stepping portion to the entire area of the stepping portion. A firm stepping grip is ensured by first metatarsal head projection T3 and fifth metatarsal head projection M2 provided at the aforementioned angles. At the left foot, the ground-contacting area of the stepping portion is enlarged towards the lateral side. The ground-contacting area is further enlarged up to the medial side heel to kick backwards in the left direction. By virtue of first metatarsal head projection T3, stepping portion projection M1, heel medial projection H1, and heel anterior projection H2, a firm stepping grip against this direction can be ensured.

During the latter period of the acceleration stage, the weight at the right foot shifts to the toe portion to kick backwards with a firm stepping grip by toe portion projections of T1 and T2. At the left foot, the weight shifts towards the medial side of the toe to kick backwards with a firm stepping grip by toe projection T1.

Figure 3:
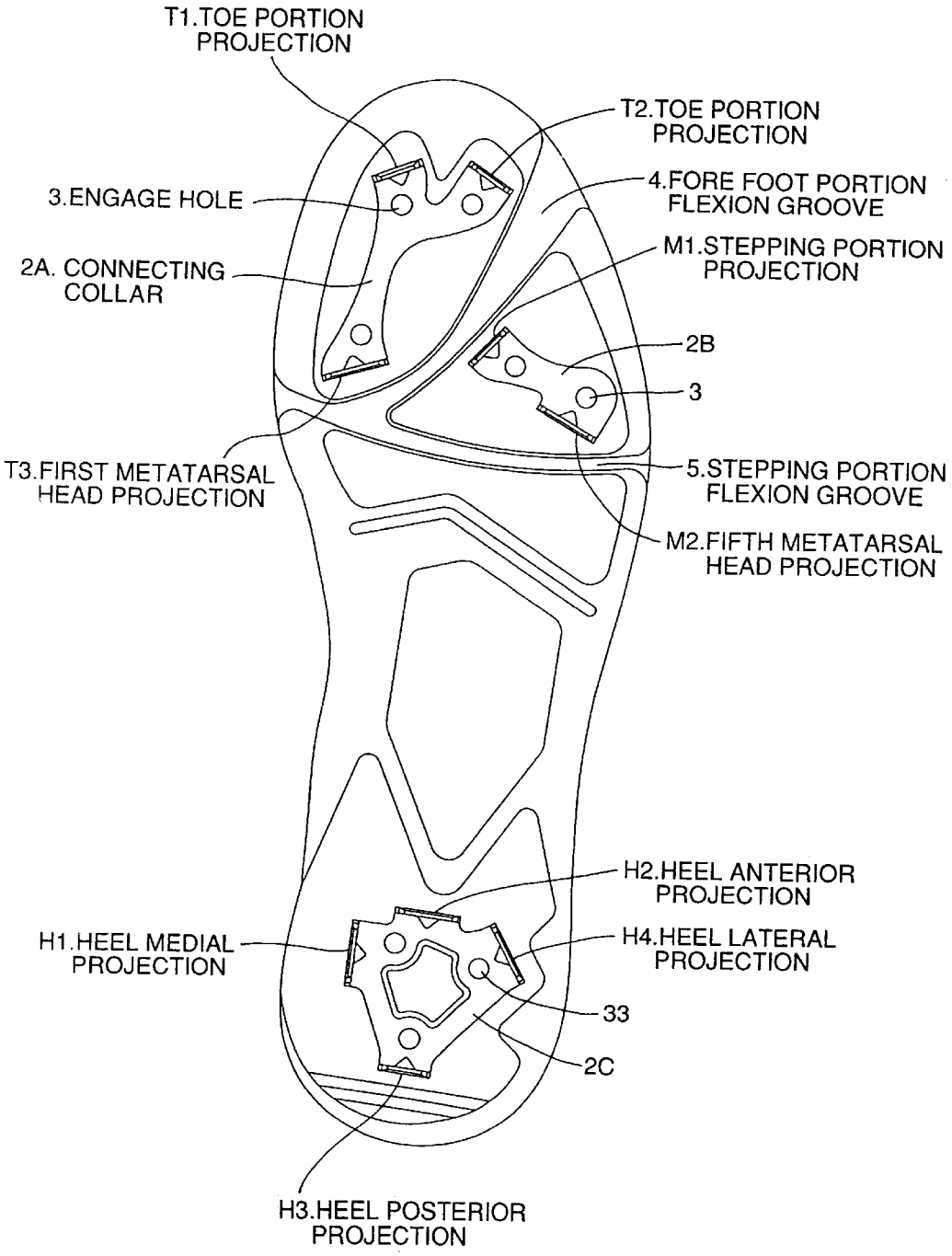
FIG. 3 is a plan view of a shoe sole according to an embodiment of the present invention.
Figure 4:
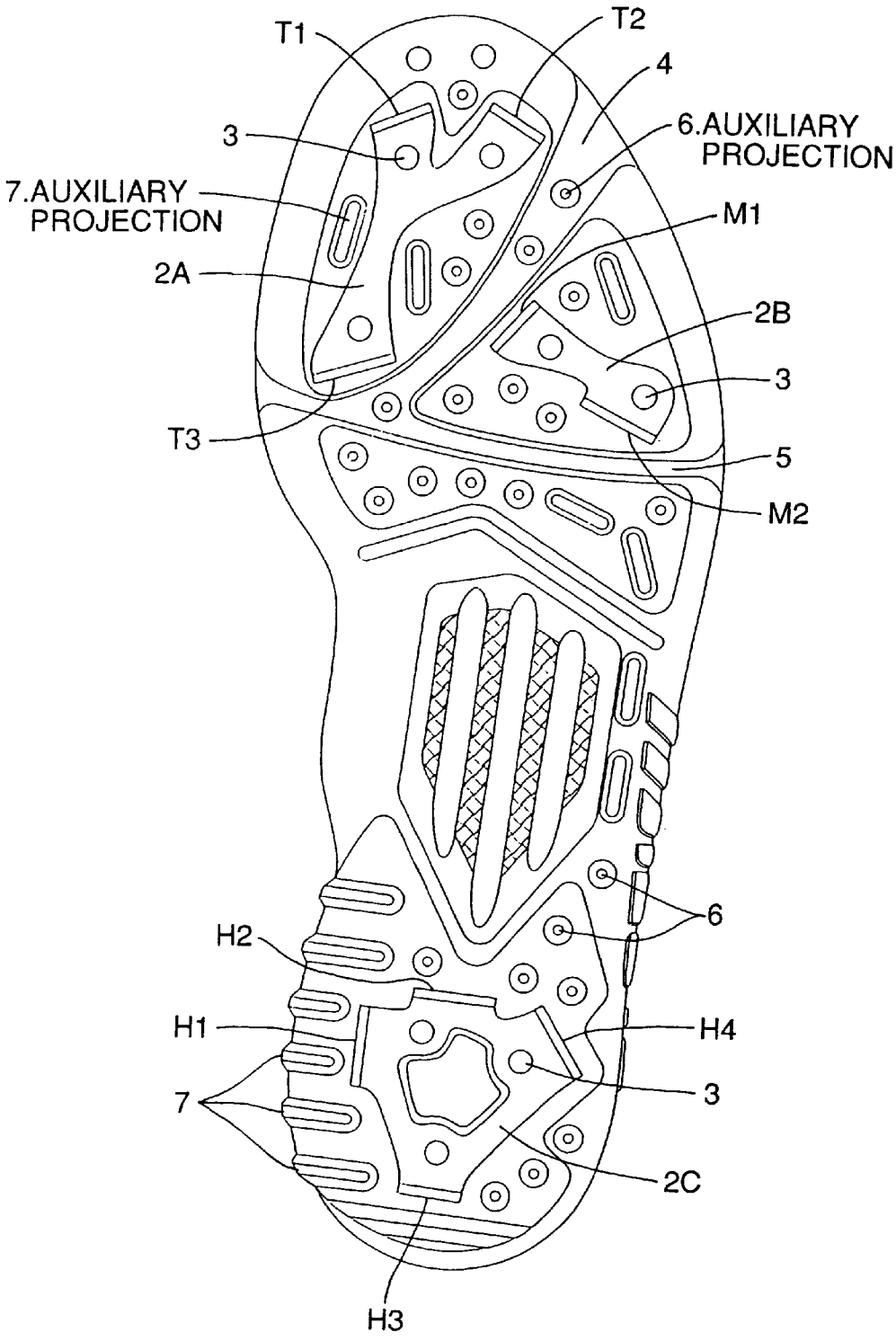
FIG. 4 is a plan view of a shoe sole according to another embodiment of the present invention.

Although the function of each projection has been described according to the present invention, the shoe sole itself must be flexible at an appropriate region in order to achieve effective usage of these projections. For this purpose, other embodiments of a baseball spiked shoe according to the present invention are shown in FIGS. 3 and 4. A stepping portion flexion groove 5 can be provided at the shoe sole body along a line connecting the metatarsal head from the hallux to the fifth phalanx. Also, a fore foot portion flexion groove 4 can be provided at the shoe sole body starting from a region posterior to toe portion projection T2 to a region posterior to first metatarsal head portion T3 via a region anterior to stepping portion projection M1.

Stepping portion flexion groove 5 is particularly effective for a running movement in the forward direction. Fore foot portion flexion groove 4 serves to effect toe portion projections T1 and T2 and first metatarsal head projection T3 provided at the fore foot portion particularly in the kinetic performance that requires a firm stepping grip at an area from the medial side of the fore foot portion to the toe portion such as in dashing, batting, and throwing sideways.

Furthermore, an auxiliary projection 6, and an auxiliary projection 7 can be provided appropriately at the surface of the shoe sole as shown in FIG. 4.

Auxiliary projections 6 and 7 support the gripping force of each projection to contribute to improve the function.

Each spike hardware of the present invention can be formed by press-working a metal plate of a predetermined configuration to provide an upright projection portion, or by casting.

Each spike hardware can be formed of a synthetic resin such as nylon, polyurethane, and the like. Alternatively, a combination of such a synthetic resin and metal is possible.

For example, connecting washer 2 can be formed of a synthetic resin, and a projection molded from metal can be fixedly attached in the proximity of the leading edge of connecting washer 2.

The method of fastening each projection of the present invention to a shoe sole is arbitrary. A projection can be fastened by a pin into a hole 3 or by a bolt and nut.

Although not shown, it is possible to bury connecting washer 2 of respective projections within the shoe sole body so that each projecting portion protrudes from the surface of the shoe sole.

In this case, each projection can be formed individually.

Figure 13:
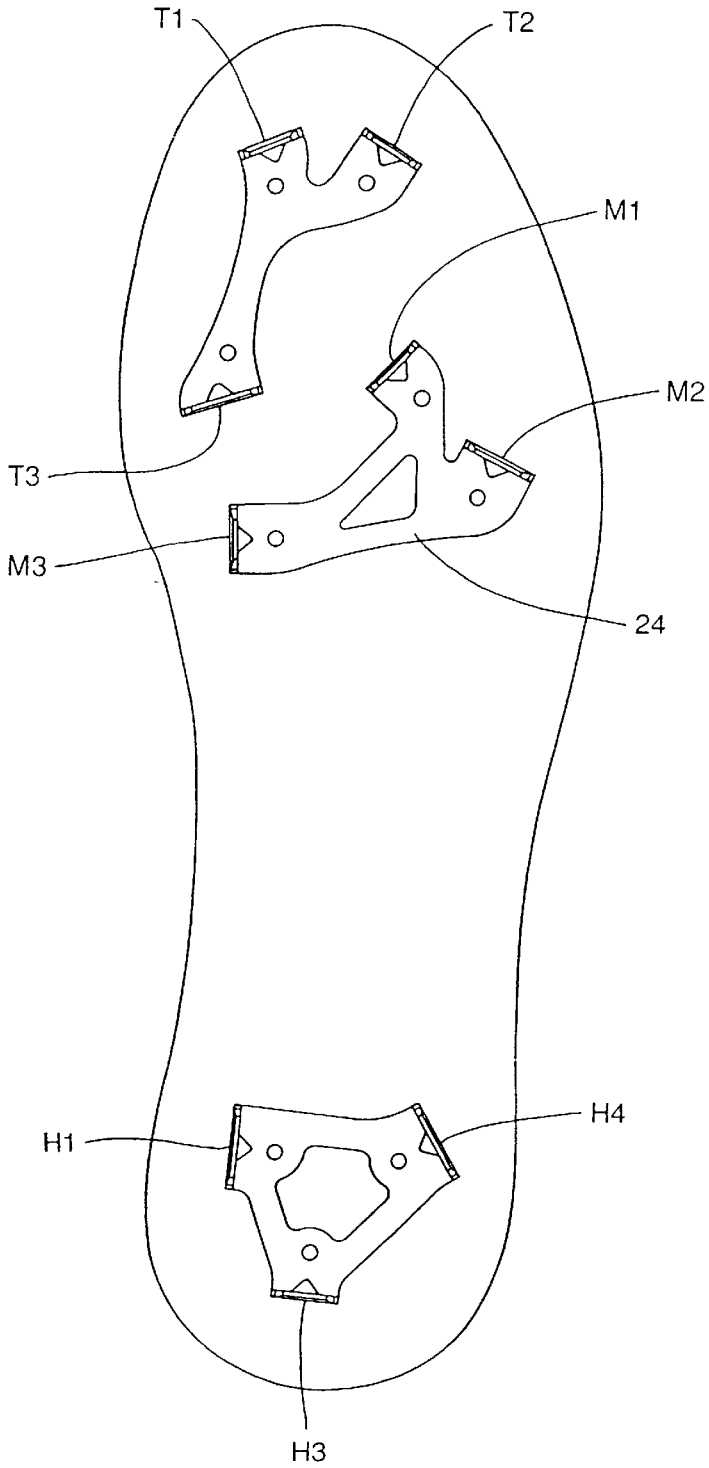
FIG. 13 is a plan view of a shoe sole according to another embodiment of the present invention.
Figure 14:
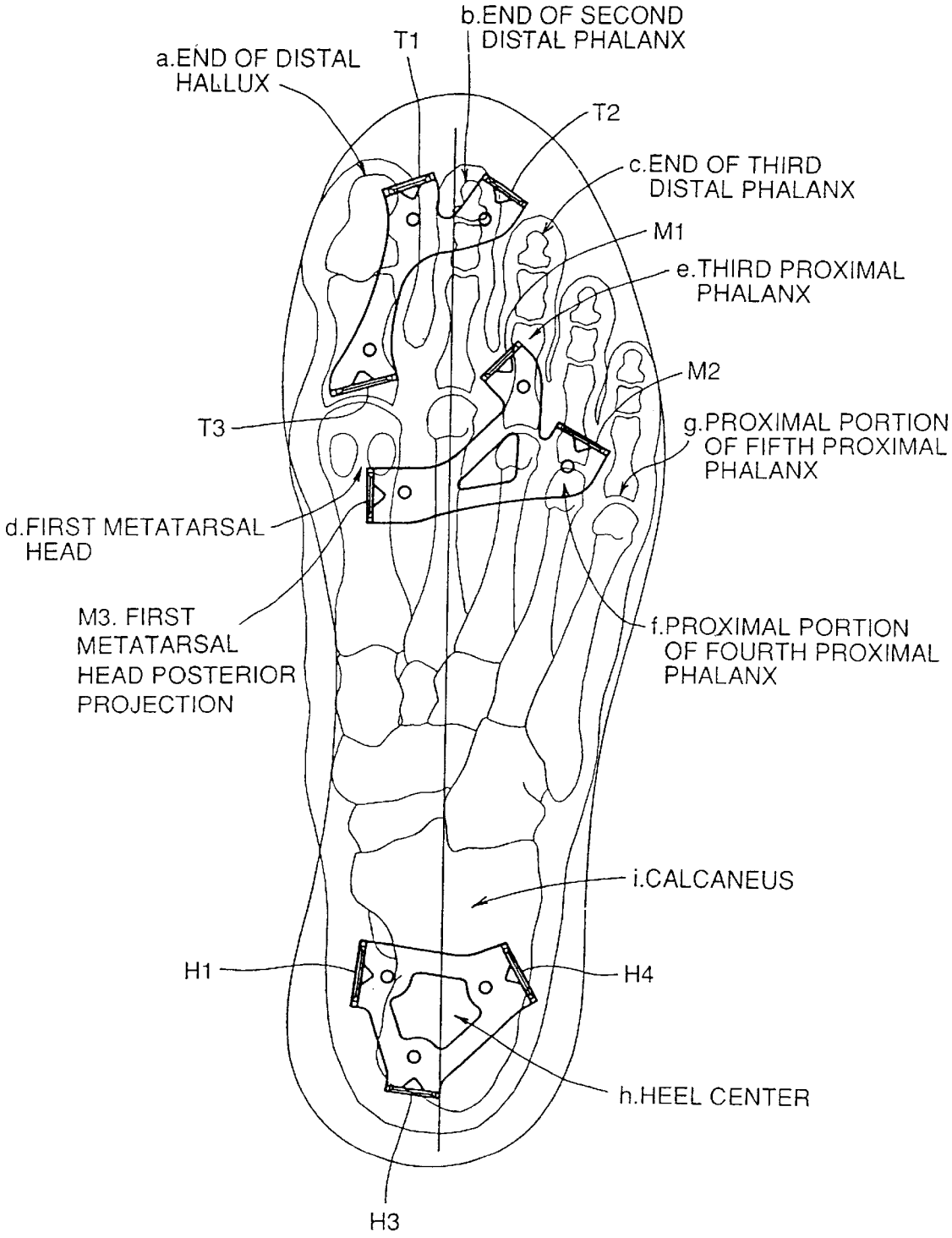
FIG. 14 schematically shows the correspondence of the location of each projection according to the present invention and the skeleton of a foot of a human body.

As another embodiment of the present invention shown in FIGS. 13 and 14, a sole of a baseball spiked shoe including toe portion projections T1 and T2, first metatarsal head projection T3, stepping portion projection M1, and fifth metatarsal head projection M2 at the bottom plane can further have a first metatarsal head posterior projection M3 provided substantially parallel to the longitudinal line of the foot slightly posterior to the first metatarsal head. Projection M3 exhibits an effective stepping grip against shearing stress working laterally in a batting action, and serves to support the gripping force of first metatarsal head projection T3.

As a further embodiment of the present invention, a sole of a baseball spiked shoe can be provided characterized by including heel medial projection H1, heel posterior projection H3, and heel lateral projection H4 excluding heel anterior projection H2 of the projections provided at the heel of the bottom of the sole.

For players that concentrate on a running movement, the kinetic performance may be improved by having heel posterior projection H3 removed.

More specifically, in making a dash at full speed, each projection at the fore foot portion exhibits a gripping force, and the heel anterior projection provides no effective function.

Figure 15:
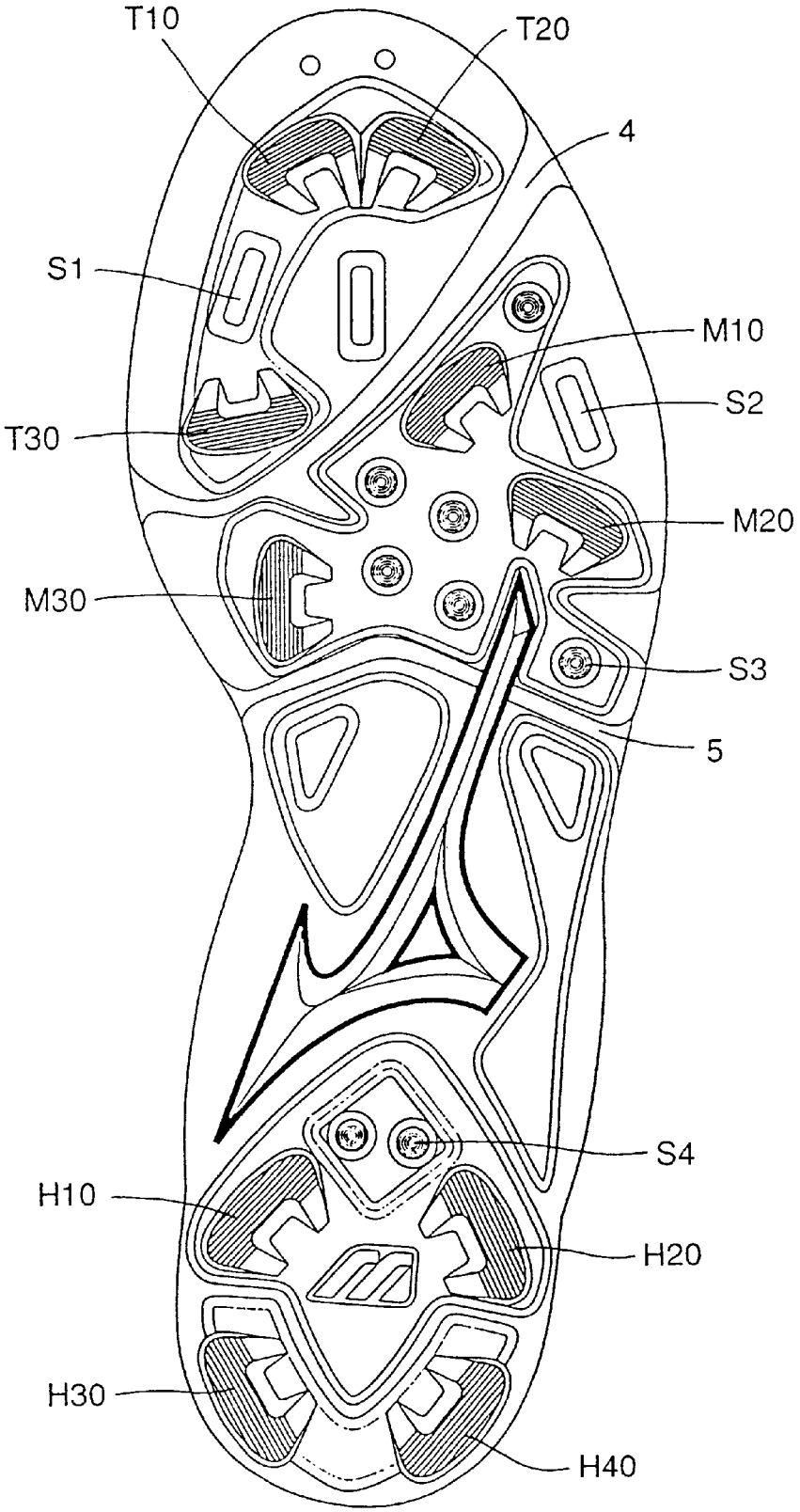
FIG. 15 shows a shoe sole according to a still further embodiment of the present invention.
Figure 16:
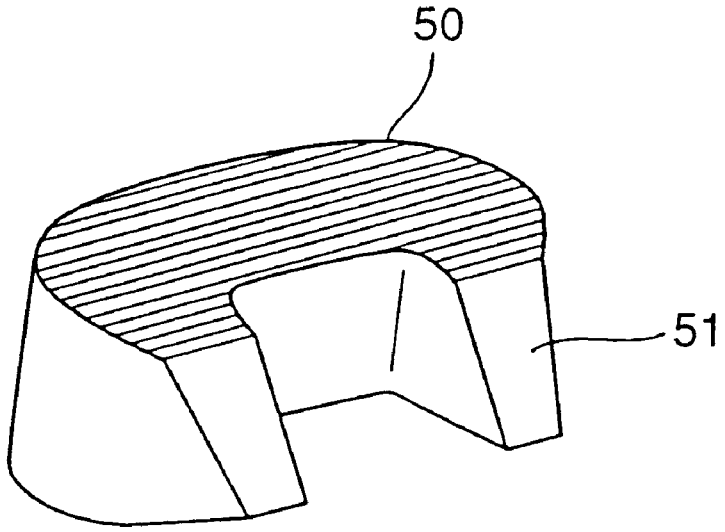
FIG. 16 shows a projection of the embodiment of FIG. 15.
Figure 17A:
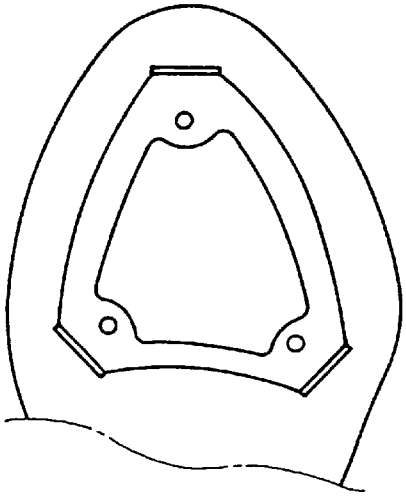
FIG. 17A PRIOR ART
FIGS. 17A and 17B are bottom plan views of a sole of a conventional baseball spiked shoe.
Figure 17B:
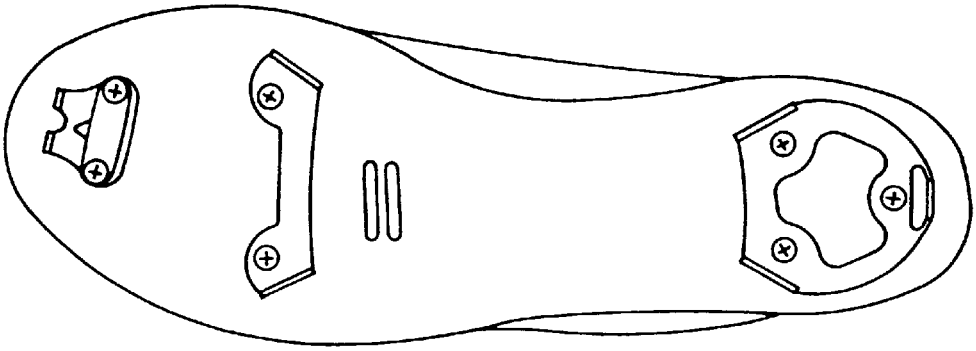
FIG. 17B PRIOR ART
Figure 18:
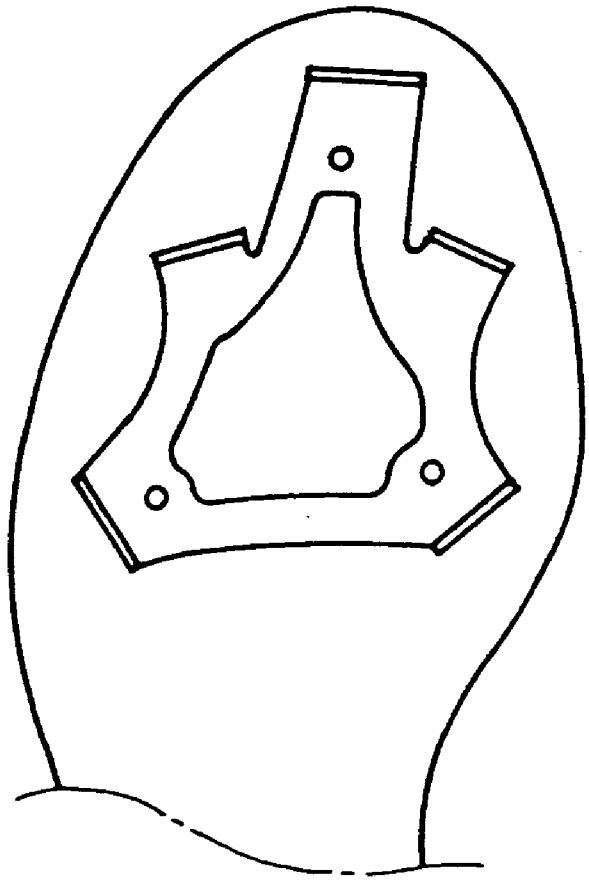
FIG. 18 PRIOR ART
FIG. 18 is a bottom plan view of a sole of another conventional baseball spiked shoe.

FIG. 15 shows a sole of a baseball spiked shoe according to a still further embodiment of the present invention. FIG. 16 shows in detail a projection used in the embodiment of FIG. 15. The embodiment of FIG. 15 has a projection 50 shown in FIG. 16 provided for each projection of the embodiment shown in FIG. 3. In contrast to the embodiment of FIG. 3 wherein each projection has a blade configuration, projection 50 of the embodiment shown in FIG. 15 has a configuration as shown in FIG. 16. Reinforcing ribs 51 are formed at one side and a plane having friction force is formed at another side.

Referring to FIG. 15, toe portion projections T10 and T20, a first metatarsal head projection T30, a stepping portion projection M10, a fifth metatarsal head projection M20, a first metatarsal head posterior projection M30, and auxiliary projections S1, S2, and S3 are provided at the toe portion, similar to those of FIG. 3.

At the heel portion, four projections H10–H40 and an auxiliary projection S4 are provided, differing in arrangement from those of FIG. 3.

The embodiments of the present invention provide the following advantages. Baseball spiked shoes of the present invention improve the efficiency of the kinetic performance by conveying the kicking force of an action reliably against the ground since each projection is provided at the most effective position according to analysis of each kinetic action.

Natural flexibility of the fore foot portion is allowed during a kinetic performance. The function of each projection is sufficiently exercised. The stress on the foot of a player is reduced to alleviate fatigue.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sole of a spiked shoe having a plurality of projections at positions corresponding to the skeleton of a foot of an appropriate size for wearing the spiked shoe, said sole comprising:

a first connecting collar secured to said sole, said first connecting collar including:

a first toe portion projection having a generally rectangular cross-section and extending from said first connecting collar at a location corresponding approximately to an end of a distal hallux of the foot, a second toe portion projection having a generally rectangular cross-section and extending from said first connecting collar at a location corresponding approximately to an end of a second distal phalanx of the foot, a first metatarsal head projection having a generally rectangular cross-section and extending from said first connecting collar at a location relatively frontward of a first metatarsal head of the foot; and a second connecting collar secured to said sole, said second connecting collar including:

a stepping portion projection having a generally rectangular cross-section and extending from said second connecting collar at a location corresponding approximately to a third proximal phalanx of the foot, and a fifth metatarsal head projection having a generally rectangular cross-section and extending from said second connecting collar at a location approximately between a proximal portion of a fourth proximal phalanx and a proximal portion of a fifth proximal phalanx of the foot.

2. A sole of a spiked shoe having a plurality of projections at positions corresponding to the skeleton of a foot of an appropriate size for wearing the spiked shoe, said sole comprising:

a first connecting collar secured to said sole, said first connecting collar including:

a first toe portion projection having a generally rectangular cross-section and extending from said first connecting collar at a location corresponding approximately to an end of a distal hallux of the foot, a second toe portion projection having a generally rectangular cross-section and extending from said first connecting collar at a location corresponding approximately to an end of a second distal phalanx of the foot, a first metatarsal head projection having a generally rectangular cross-section and extending from said first connecting collar at a location relatively frontward of a first metatarsal head of the foot; and a second connecting collar secured to said sole, said second connecting collar including:

a stepping portion projection having a generally rectangular cross-section and extending from said second connecting collar at a location corresponding approximately to a third proximal phalanx of the foot, and a fifth metatarsal head projection having a generally rectangular cross-section and extending from said second connecting collar at a location approximately between a proximal portion of a fourth proximal phalanx and a proximal portion of a fifth proximal phalanx of the foot, and a heel connecting collar secured to said sole, said heel connecting collar including:

a heel medial projection having a generally rectangular cross-section and extending from said heel connecting collar at approximately the medial side of a heel center of the foot, a heel posterior projection having a generally rectangular cross-section and extending from said heel connecting collar at approximately the posterior of the heel center, and a heel lateral projection having a generally rectangular cross-section and extending from said heel connecting collar at approximately the lateral side of the heel center;

said heel medial projection being disposed such that a face thereof is substantially parallel to a longitudinal line of the foot;

said heel posterior projection being disposed such that a face thereof is substantially perpendicular to the longitudinal line of the foot; and said heel lateral projection being disposed such that a face thereof forms an angle of 20°~45° with respect to the longitudinal line of the foot.

3. The sole of a baseball spiked shoe according to claim 1, wherein said second connecting collar further includes a first metatarsal head posterior projection having a generally rectangular cross-section and extending from said second connecting collar at a location relatively posterior to said first metatarsal head projection, said first metatarsal head posterior projection being oriented such that a face thereof is substantially parallel to the longitudinal line of the foot.

4. The sole of a baseball spiked shoe according to claim 1, wherein said first metatarsal head projection is disposed so that a face thereof forms an angle of 45°~90° with respect to the longitudinal line of the foot.

5. The sole of a baseball spiked shoe according to claim 1, wherein said stepping portion projection is disposed so that a face thereof forms an angle of 30°~60° with respect to the longitudinal line of the foot.

6. The sole of a baseball spiked shoe according to claim 1, wherein said fifth metatarsal head projection is disposed so that a face thereof forms an angle of 50°~80° with respect to the longitudinal line of the foot.

7. The sole of a baseball spiked shoe according to claim 1, wherein each projection is formed of metal.

8. The sole of a baseball spiked shoe according to claim 1, wherein each said projection is formed of a synthetic resin.

9. The sole of a baseball spiked shoe according to claim 1, further comprising a stepping portion flexion groove along a line connecting a metatarsal head from the hallux to a fifth phalanx at said shoe sole main body and curved in a convex manner towards the heel direction.

10. The sole of a baseball spiked shoe according to claim 1, further comprising a fore foot portion flexion groove at said shoe sole main body starting from a region posterior to said toe portion projection to a region posterior to said first metatarsal head projection via a region anterior to said stepping portion projection.

11. The sole of a baseball spiked shoe according to claim 2, further comprising a heel anterior projection having a generally rectangular cross-section and extending from a location frontward of the heel center, said heel anterior projection being oriented such that a face thereof is substantially perpendicular to the longitudinal line of the foot.

12. The sole of a baseball spiked shoe according to claim 2, wherein said second connecting collar further includes a first metatarsal head posterior projection having a generally rectangular cross-section and extending from said second connecting collar at a location relatively posterior to said first metatarsal head projection, said first metatarsal head posterior projection being oriented substantially parallel to the longitudinal line of the foot.

13. The sole of a baseball spiked shoe according to claim 2, wherein said first metatarsal head projection is disposed so that a face thereof forms an angle of 45°~90° with respect to the longitudinal line of the foot.

14. The sole of a baseball spiked shoe according to claim 2, wherein said stepping portion projection is disposed so that a face thereof forms an angle of 30°~60° with respect to the longitudinal line of the foot.

15. The sole of a baseball spiked shoe according to claim 2, wherein said fifth metatarsal head projection is disposed so that a face thereof forms an angle of 50°~80° with respect to the longitudinal line of the foot.

16. The sole of a baseball spiked shoe according to claim 2, wherein each projection is formed of metal.

17. The sole of a baseball spiked shoe according to claim 3, wherein each projection is formed of metal.

18. The sole of a baseball spiked shoe according to claim 4, wherein each projection is formed of metal.

19. The sole of a baseball spiked shoe according to claim 5, wherein each projection is formed of metal.

20. The sole of a baseball spiked shoe according to claim 6, wherein each projection is formed of metal.

21. The sole of a baseball spiked shoe according to claim 2, wherein each said projection is formed of a synthetic resin.

22. The sole of a baseball spiked shoe according to claim 3, wherein each said projection is formed of a synthetic resin.

23. The sole of a baseball spiked shoe according to claim 4, wherein each said projection is formed of a synthetic resin.

24. The sole of a baseball spiked shoe according to claim 5, wherein each said projection is formed of a synthetic resin.

25. The sole of a baseball spiked shoe according to claim 6, wherein each said projection is formed of a synthetic resin.

26. The sole of a baseball spiked shoe according to claim 2, further comprising a stepping portion flexion groove along a line connecting a metatarsal head from the hallux to a fifth phalanx at said shoe sole main body and curved in a convex manner towards the heel direction.

27. The sole of a baseball spiked shoe according to claim 3, further comprising a stepping portion flexion groove along a line connecting a metatarsal head from the hallux to a fifth phalanx at said shoe sole main body and curved in a convex manner towards the heel direction.

28. The sole of a baseball spiked shoe according to claim 4, further comprising a stepping portion flexion groove along a line connecting a metatarsal head from the hallux to a fifth phalanx at said shoe sole main body and curved in a convex manner towards the heel direction.

29. The sole of a baseball spiked shoe according to claim 5, further comprising a stepping portion flexion groove along a line connecting a metatarsal head from the hallux to a fifth phalanx at said shoe sole main body and curved in a convex manner towards the heel direction.

30. The sole of a baseball spiked shoe according to claim 6, further comprising a stepping portion flexion groove along a line connecting a metatarsal head from the hallux to a fifth phalanx at said shoe sole main body and curved in a convex manner towards the heel direction.

31. The sole of a baseball spiked shoe according to claim 7, further comprising a stepping portion flexion groove along a line connecting a metatarsal head from the hallux to a fifth phalanx at said shoe sole main body and curved in a convex manner towards the heel direction.

32. The sole of a baseball spiked shoe according to claim 8, further comprising a stepping portion flexion groove along a line connecting a metatarsal head from the hallux to a fifth phalanx at said shoe sole main body and curved in a convex manner towards the heel direction.

33. The sole of a baseball spiked shoe according to claim 2, further comprising a fore foot portion flexion groove at said shoe sole main body starting from a region posterior to said toe portion projection to a region posterior to said first metatarsal head projection via a region anterior to said stepping portion projection.

34. The sole of a baseball spiked shoe according to claim 3, further comprising a fore foot portion flexion groove at said shoe sole main body starting from a region posterior to said toe portion projection to a region posterior to said first metatarsal head projection via a region anterior to said stepping portion projection.

35. The sole of a baseball spiked shoe according to claim 4, further comprising a fore foot portion flexion groove at said shoe sole main body starting from a region posterior to said toe portion projection to a region posterior to said first metatarsal head projection via a region anterior to said stepping portion projection.

36. The sole of a baseball spiked shoe according to claim 5, further comprising a fore foot portion flexion groove at said shoe sole main body starting from a region posterior to said toe portion projection to a region posterior to said first metatarsal head projection via a region anterior to said stepping portion projection.

37. The sole of a baseball spiked shoe according to claim 6, further comprising a fore foot portion flexion groove at said shoe sole main body starting from a region posterior to said toe portion projection to a region posterior to said first metatarsal head projection via a region anterior to said stepping portion projection.

38. The sole of a baseball spiked shoe according to claim 7, further comprising a fore foot portion flexion groove at said shoe sole main body starting from a region posterior to said toe portion projection to a region posterior to said first metatarsal head projection via a region anterior to said stepping portion projection.

39. The sole of a baseball spiked shoe according to claim 8, further comprising a fore foot portion flexion groove at said shoe sole main body starting from a region posterior to said toe portion projection to a region posterior to said first metatarsal head projection via a region anterior to said stepping portion projection.

40. The sole of a baseball spiked shoe according to claim 9, further comprising a fore foot portion flexion groove at said shoe sole main body starting from a region posterior to said toe portion projection to a region posterior to said first metatarsal head projection via a region anterior to said stepping portion projection.

* * * * *